US005203589A

United States Patent [19]

Tio

[11] Patent Number: 5,203,589

[45] Date of Patent: Apr. 20, 1993

[54] SKI POLE ARRANGEMENT

[76] Inventor: Richard C. Tio, 87-25 Clover Pl., Jamaica Estates, N.Y. 11423

[21] Appl. No.: 874,435

[22] Filed: Apr. 27, 1992

[51] Int. Cl.[5] ..... A63C 11/22

[52] U.S. Cl. ..... 280/816; 280/821; 135/66; 368/10; 368/107; 368/113

[58] Field of Search ..... 280/606, 809, 816, 819, 280/820, 821, 822, 823, 824; 135/16, 65, 66, 76; 368/10, 103, 104, 107, 110, 113

[56] References Cited

U.S. PATENT DOCUMENTS

| | | | |
|---|---|---|---|
| 3,576,332 | 4/1971 | Bruckl | 280/820 |
| 3,746,356 | 7/1973 | Shipstad | 280/821 |
| 4,068,610 | 1/1978 | Teson | 280/821 X |
| 4,288,102 | 9/1981 | Romer | 280/821 X |
| 4,316,620 | 2/1982 | Wien | 280/824 |
| 4,505,285 | 3/1985 | French | 135/16 X |
| 4,641,857 | 2/1987 | Gailiunas | 280/821 |
| 4,793,627 | 12/1988 | Monreal | 280/824 X |
| 5,029,897 | 7/1991 | Borg | 280/821 X |
| 5,056,545 | 10/1991 | Spaeth | 135/66 |

FOREIGN PATENT DOCUMENTS

| | | | |
|---|---|---|---|
| 180027 | 3/1954 | Austria | 280/816 |
| 2306237 | 8/1974 | Fed. Rep. of Germany | 280/821 |
| 2518783 | 11/1976 | Fed. Rep. of Germany | 280/819 |
| 2509620 | 1/1983 | France | 280/820 |
| 8002649 | 12/1980 | World Int. Prop. O. | 280/821 |

*Primary Examiner*—Brian Johnson
*Attorney, Agent, or Firm*—Leon Gilden

[57] ABSTRACT

A ski pole is formed with a handle having spaced lugs mounted thereon divided by parallel slots. The lugs include an arcuate rear face and a planar forward face, with the planar forward face positioned above an arcuate recess of a convex configuration to enhance grasping and securement of the ski pole. The ski pole head mounting the lugs includes a swivel connection permitting angular orientation of the ski pole handle relative to the ski pole shaft.

2 Claims, 4 Drawing Sheets

FIG 7
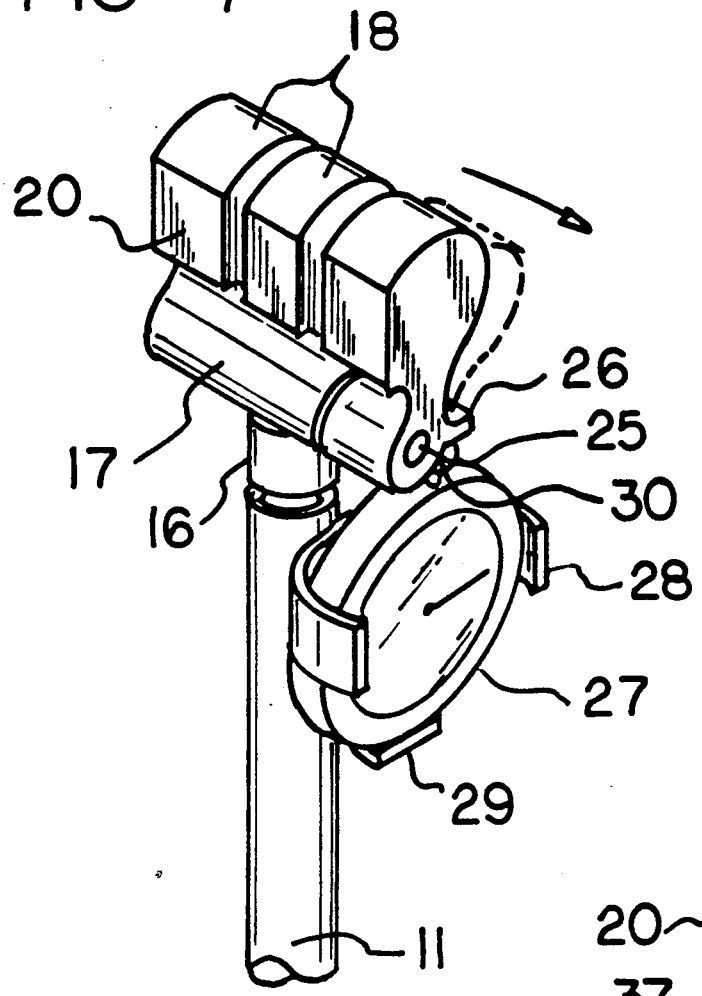
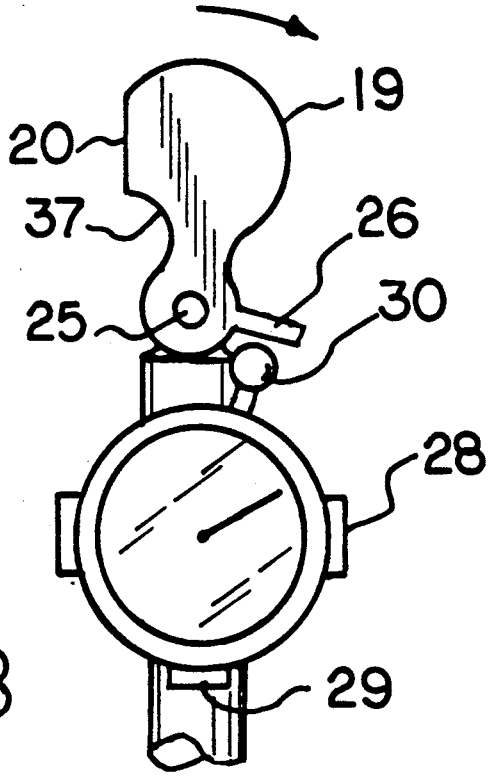
FIG 8

FIG 9
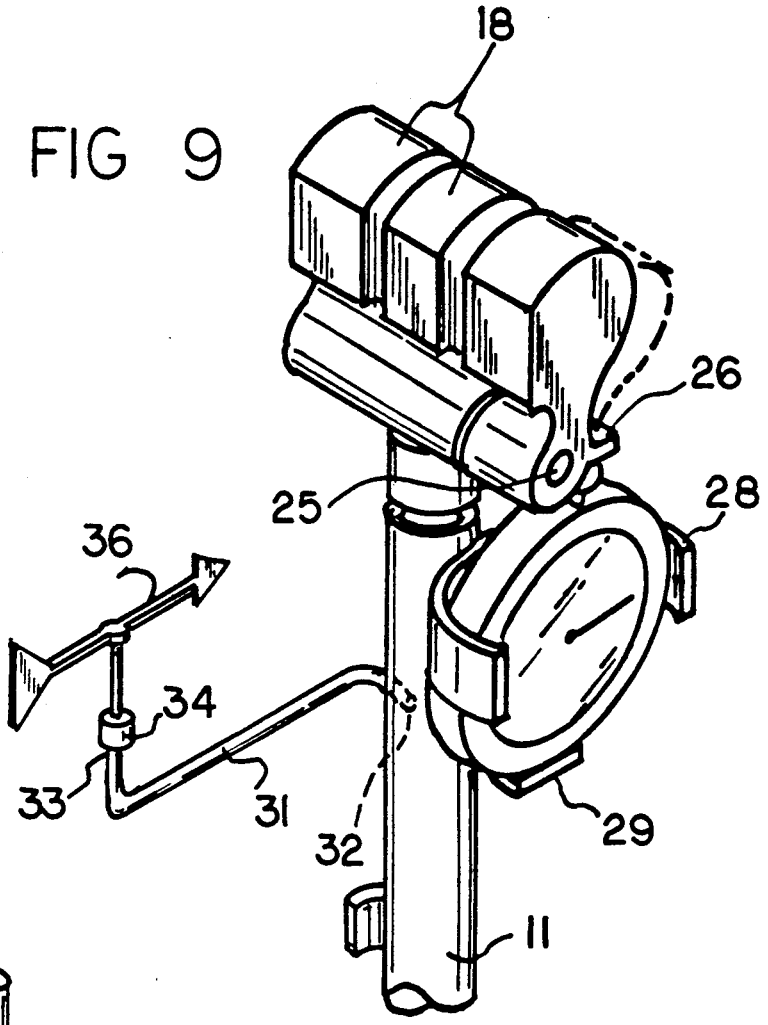
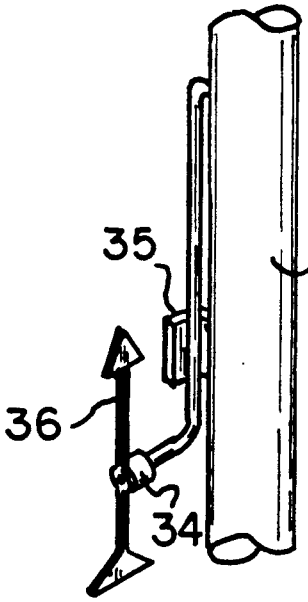
FIG 10

SKI POLE ARRANGEMENT

BACKGROUND OF THE INVENTION

1. Field of the Invention

The field of invention relates to ski pole construction, and more particularly pertains to a new and improved ski pole arrangement wherein the same has a pivotally mounted head including spaced, uniquely configured lugs to enhance grasping and manipulation of the ski pole structure.

2. Description of the Prior Art

Ski poles of various types have been utilized throughout the prior art. To accommodate stress and control of the ski pole arrangement, the instant invention directs a generally T-shaped handle pivotally mounted to a shaft structure to permit angular positioning of the ski pole during use. Prior art ski pole structures are exemplified in the U.S. Pat. Nos. 4,793,627; 4,288,102; 3,576,332; 4,316,620; and 4,068,610.

Accordingly, it may be appreciated that there continues to be a need for a new and improved ski pole arrangement as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of ski pole structures now present in the prior art, the present invention provides a ski pole arrangement wherein the same is provided with a T-shaped handle pivotally mounted to an associated shaft by use of a ball and socket inter-relationship. As such, the general purpose of the present invention, which will be described subsequently in greater detail, is to provide a new and improved ski pole arrangement which has all the advantages of the prior art ski pole construction and none of the disadvantages.

To attain this, the present invention provides a ski pole formed with a handle having spaced lugs mounted thereon divided by parallel slots. The lugs include an arcuate rear face and a planar forward face, with the planar forward face positioned above an arcuate recess of a convex configuration to enhance grasping and securement of the ski pole. The ski pole head mounting the lugs includes a swivel connection permitting angular orientation of the ski pole handle relative to the ski pole shaft.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved ski pole arrangement which has all the advantages of the prior art ski pole construction and none of the disadvantages.

It is another object of the present invention to provide a new and improved ski pole arrangement which may be easily and efficiently manufactured and marketed.

It is a further object of the present invention to provide a new and improved ski pole arrangement which is of a durable and reliable construction.

Still yet another object of the present invention is to provide a new and improved ski pole arrangement which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of the instant invention.

FIG. 7 is a modified aspect of the invention.

FIG. 8 is an orthographic side view of the invention, as set forth in FIG. 7.

FIG. 9 is an isometric illustration of the invention including a wind directional indicator.

FIG. 10 is an isometric illustration of the wind directional indicator in a stored position relative to the ski pole shaft.

DESCRIPTION OF THE PREFERRED EMBODIMENT

Figure 2:
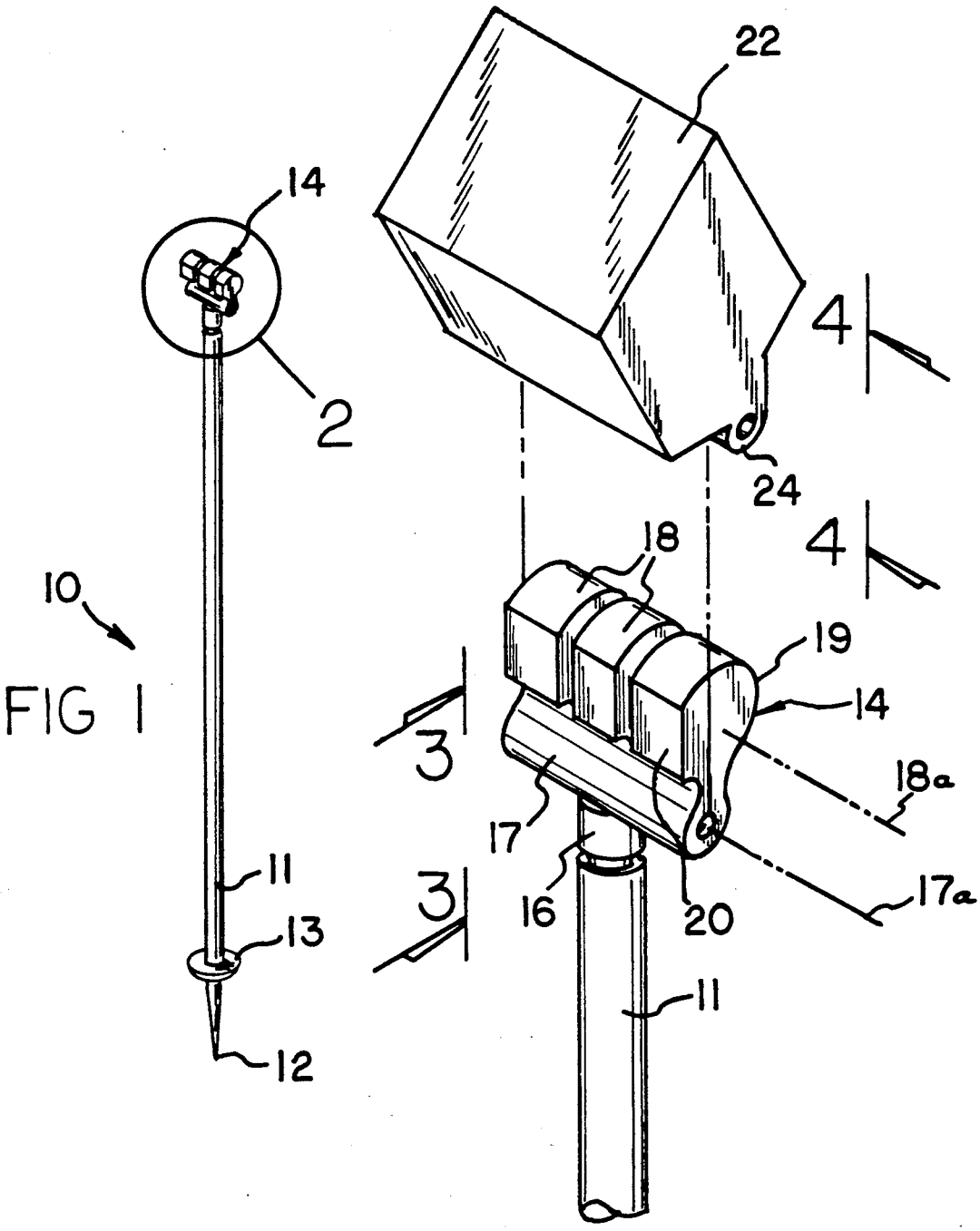
FIG. 2 is an enlarged isometric view of section 2 as set forth in FIG. 1, employing a cover cap.
Figure 3:
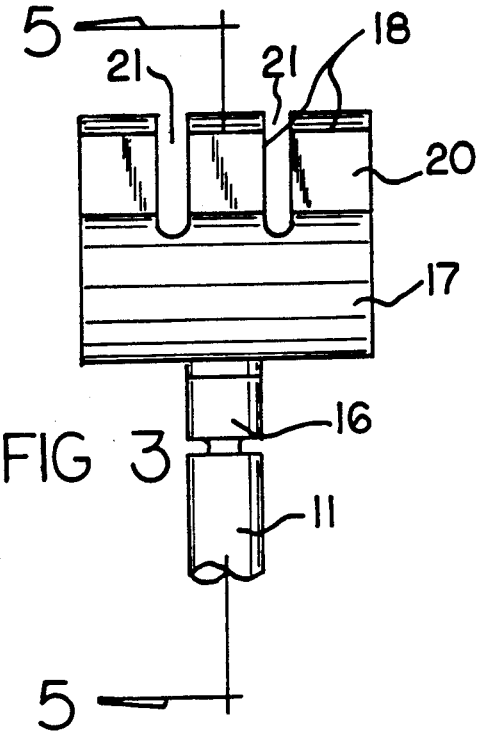
FIG. 3 is an orthographic view, taken along the lines 3—3 of FIG. 2 in the direction indicated by the arrows.
Figure 4:
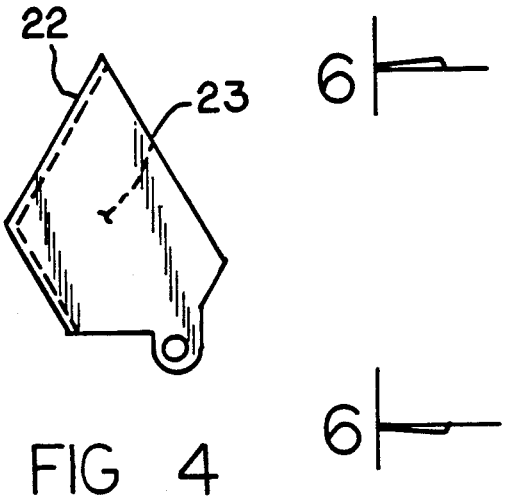
FIG. 4 is an orthographic view, taken along the lines 4—4 of FIG. 2 in the direction indicated by the arrows.
Figure 6:
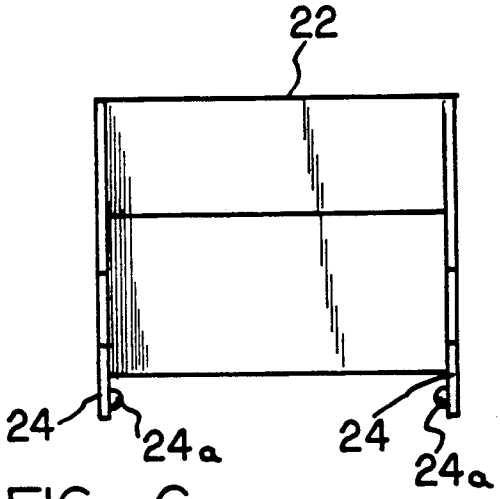
FIG. 6 is an orthographic view, taken along the lines 6—6 of FIG. 4 in the direction indicated by the arrows.
Figure 5:
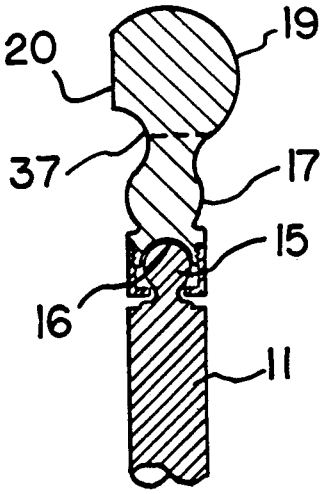
FIG. 5 is an orthographic cross-sectional illustration of the invention, taken along the lines 5—5 of FIG. 3 in the direction indicated by the arrows.

With reference now to the drawings, and in particular to FIGS. 1 to 10 thereof, a new and improved ski pole arrangement embodying the principles and concepts of the present invention and generally designated by the reference numeral 10 will be described.

More specifically, the ski pole arrangement 10 of the instant invention essentially comprises a ski pole shaft 11 having a lower distal end formed as a lower conical tip 12 for projection into snow and ice during use, with abutment plate 13 mounted coaxially about the shaft 11 adjacent the lower conical tip 12. A handle assembly 14 is provided having a handle socket 16 mounted and formed at a lower distal end thereof. The handle assembly 14 is of a generally T-shaped configuration, with a support cylindrical handle base 17 orthogonally mounted to the handle socket 16, with the handle socket medially intersecting in an orthogonal relationship the cylindrical handle base 17. A support sphere 15 is formed at an upper distal end of the shaft 11 and received within the handle socket 16 to permit pivotal and selective orientation of the T-shaped handle assembly 14 relative to the shaft 11.

Spaced grasping lugs 18 are provided, with the lugs coaxially aligned relative to one another mounted coextensively along a side portion of the cylindrical handle base 17, with the lugs 18 arranged having a lug axis 18*a* parallel to and spaced above the handle base axis 17*a*.

Each of the lugs is formed with a semi-cylindrical rear wall 19 merging into a planar forward wall 20. The planar forward wall 20 of each lug 18 is arranged in a coplanar relationship relative to one another, with the lugs including spaced parallel slots 21 directed therebetween. An arcuate recess 37 is defined between the planar forward walls 20 and the cylindrical handle base 17 to receive an individual's fingers therewithin. If desired, a cover hood 22 may be provided having a cover hood cavity 23 arranged for receiving the lugs 18 therewithin, with the cover hood including side walls having a resilient ear 24 mounted in coplanar relationship relative to each side wall projecting therebelow. The resilient ears 24 are arranged to include ear lugs 24*a* projecting into the axle bore of the cylindrical handle base 17.

A modified handle structure is illustrated in the FIG. 7, wherein an outermost lug 18 includes an actuator leg 26 integrally mounted to the handle base 17 below the lug 18, with the actuator leg cooperative with an actuator button 30 of an associated stop watch 27. The stop watch 27 is mounted within an upper and lower support strap 28 and 29 respectively to secure the stop watch therewithin. The upper strap 28 is of a generally U-shaped configuration and the lower strap 29 of a generally L-shaped configuration to secure the stop watch therewithin. The actuation button is arranged adjacent the actuator leg for selective actuation of the actuation button upon pivoting of the outermost grasping lug 18.

The FIG. 9 and the FIG. 10 indicate a wind vane link 31 pivotally mounted about a link first end 32 to the shaft 11, with the wind vane link 31 having a second end 33. rotatably mounting a vane collar 34 thereabout. The vane collar includes a wind vane leg 36 fixedly mounted to a top surface of the collar for wind directional indication. The wind vane link 31 during periods of non-use is received within a positioning loop 35 mounted to a side wall of the shaft 11.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A ski pole arrangement, comprising, a ski pole shaft, the ski pole shaft including a lower conical tip formed at a lower distal end of the shaft, and an upper distal end of the shaft including a support sphere member coaxially aligned with the shaft, and a T-shaped handle assembly pivotally mounted to the support sphere, the T-shaped handle assembly including a handle socket receiving the support sphere therewithin, the handle socket orthogonally and medially intersecting a support cylindrical handle base, and the handle base includes a handle base axis directed through the handle base, with the handle base axis orthogonally oriented relative to the handle socket, and a plurality of spaced grasping lugs integrally mounted to the handle base, with a plurality of the grasping lugs longitudinally aligned about a lug axis, with the lug axis arranged parallel relative to the handle base axis, and the grasping lugs include spaced parallel slots positioned between adjacent grasping lugs, and each grasping lug includes a semi-cylindrical rear wall and a planar forward wall, and an arcuate recess is directed into the T-shaped handle between the planar forward wall of each grasping lug and the handle base, and a cover hood, the cover hood including a cover hood cavity for receiving the T-shaped handle therewithin, and the cover hood including spaced parallel resilient ears projecting below the cover hood, the handle base including handle bores at each distal end of the handle base coaxially aligned with the handle base axis and each of said ears includes an ear lug directed into one of said bores, and an outermost one of said grasping lugs is pivotally mounted about the handle base axis, and said outermost grasping lug includes an actuator leg fixedly mounted relative to said handle base axis diametrically aligned relative to said handle base axis, and a stop watch mounted to said shaft below said handle, said stop watch including an actuator button, the actuator button arranged adjacent the actuator leg for selective actuation of the actuator button upon pivoting of said outermost grasping lug.

2. A ski pole as set forth in claim 1 including a wind vane link having a first end pivotally mounted relative to said shaft, and a second end rotatably mounting a vane collar, the vane collar including a wind vane leg mounted to a top surface of the vane collar, and a positioning loop mounted to said shaft, the positioning loop arranged for receiving said link at a second pivot position relative to a first pivot position, wherein said link is orthogonally oriented relative to said shaft.

* * * * *